US009834935B2

(12) United States Patent
Loftus et al.

(10) Patent No.: US 9,834,935 B2
(45) Date of Patent: Dec. 5, 2017

(54) GRANULE COATED WATERPROOF ROOFING MEMBRANE

(71) Applicant: Owens Corning Intellectual Capital, LLC, Toledo, OH (US)

(72) Inventors: James E. Loftus, Newark, OH (US); Jay D. Wagner, Holland, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 14/645,500

(22) Filed: Mar. 12, 2015

(65) Prior Publication Data

US 2015/0184390 A1 Jul. 2, 2015

Related U.S. Application Data

(62) Division of application No. 13/614,001, filed on Sep. 13, 2012, now abandoned.

(60) Provisional application No. 61/533,999, filed on Sep. 13, 2011.

(51) Int. Cl.

| | |
|---|---|
| ***E04D 5/12*** | (2006.01) |
| ***E04D 5/10*** | (2006.01) |
| ***E04D 5/14*** | (2006.01) |
| ***D06N 5/00*** | (2006.01) |

(52) U.S. Cl.

CPC ..... *E04D 5/12* (2013.01); *D06N 5/006* (2013.01); *E04D 5/10* (2013.01); *E04D 5/148* (2013.01); *Y10T 428/24372* (2015.01); *Y10T 428/24388* (2015.01)

(58) Field of Classification Search

CPC .. E04D 5/12; E04D 5/148; E04D 5/10; D06N 5/006; Y10T 428/24355; Y10T 428/2438; Y10T 428/24388; Y10T 428/24372

USPC ..... 428/141, 143, 144, 145

See application file for complete search history.

(56) References Cited

U.S. PATENT DOCUMENTS

| | | | | |
|---|---|---|---|---|
| 3,770,559 | A | 11/1973 | Jackson | |
| 4,091,135 | A | 5/1978 | Tajima et al. | |
| 4,735,833 | A | 4/1988 | Chiotis et al. | |
| 4,738,884 | A | 4/1988 | Algrim et al. | |
| 5,054,174 | A * | 10/1991 | Krenzer | D02G 1/168 28/271 |
| 5,456,983 | A * | 10/1995 | Sassa | B01D 39/083 428/221 |
| 5,496,615 | A | 3/1996 | Bartlett et al. | |
| 5,547,707 | A | 8/1996 | Haubert et al. | |
| 5,549,966 | A * | 8/1996 | Sassa | B01D 39/083 428/421 |
| 5,571,610 | A | 11/1996 | Loftus et al. | |
| 5,667,611 | A * | 9/1997 | Sassa | B01D 39/083 139/426 R |
| 5,718,787 | A | 2/1998 | Gallagher et al. | |
| 5,746,830 | A | 5/1998 | Burton et al. | |

(Continued)

OTHER PUBLICATIONS

International Search Report and Written Opinion from PCT/US12/55113 dated Dec. 7, 2012.

(Continued)

*Primary Examiner* — Nathan Van Sell

(74) *Attorney, Agent, or Firm* — Calfee, Halter & Griswold LLP

(57) ABSTRACT

A roofing membrane includes a membrane layer. An adhesive layer is adhered to a first side of the membrane layer and a layer of granules is adhered to the first adhesive layer.

19 Claims, 11 Drawing Sheets

(56) References Cited

U.S. PATENT DOCUMENTS

| | | | | |
|---|---|---|---|---|
| 6,228,422 | B1 | 5/2001 | White et al. | |
| 6,296,912 | B1 | 10/2001 | Zickell | |
| 6,296,921 | B1 | 10/2001 | Blackmore et al. | |
| 6,531,200 | B2 | 3/2003 | Zickell et al. | |
| 6,610,147 | B2 | 8/2003 | Aschenbeck | |
| 7,125,601 | B1 | 10/2006 | Pinault et al. | |
| 7,163,716 | B2 | 1/2007 | Aschenbeck | |
| 7,441,381 | B2 | 10/2008 | Scheirer et al. | |
| 7,887,900 | B2 | 2/2011 | DiPede | |
| 2003/0089098 | A1* | 5/2003 | Bodmer | D02G 1/165 57/245 |
| 2005/0053746 | A1* | 3/2005 | Bartek | B32B 11/04 428/40.1 |
| 2005/0238848 | A1 | 10/2005 | Fensel et al. | |
| 2005/0252137 | A1 | 11/2005 | Bartek et al. | |
| 2005/0282449 | A1* | 12/2005 | Mehta | B32B 27/12 442/35 |
| 2006/0199453 | A1* | 9/2006 | Kuhn | B32B 5/26 442/38 |
| 2006/0201610 | A1 | 9/2006 | Bartek | |
| 2006/0254855 | A1 | 11/2006 | Loftus et al. | |
| 2008/0233825 | A1 | 9/2008 | Gamaleidin | |
| 2009/0252961 | A1* | 10/2009 | Eguchi | D02G 3/36 428/373 |
| 2009/0291249 | A1* | 11/2009 | Mehta | E04D 5/10 428/86 |
| 2009/0317593 | A1 | 12/2009 | Smith et al. | |
| 2010/0236178 | A1 | 9/2010 | Loftus | |
| 2010/0239807 | A1 | 9/2010 | Grubka et al. | |
| 2011/0049275 | A1 | 3/2011 | Zickell et al. | |
| 2013/0065020 | A1 | 3/2013 | Loftus et al. | |

OTHER PUBLICATIONS

Office action from U.S. Appl. No. 13/614,001 dated Oct. 24, 2013.
Office action from U.S. Appl. No. 13/614,001 dated May 9, 2014.
Notice of Panel Decision from U.S. Appl. No. 13/614,001 dated Nov. 13, 2014.
DuPont Elvaloy Dee Polymer Overview, "Better PVC Roofing Membranes begin at the molecular level", 4 page brochure, 2010.
Webpages from Fibertite.com, 4 pages, printed Mar. 30, 2015.

* cited by examiner

GRANULE COATED WATERPROOF ROOFING MEMBRANE

RELATED APPLICATIONS

The present application is a divisional application of U.S. Ser. No. 13/614,001, filed Sep. 13, 2012, titled GRANULE COATED WATERPROOF ROOFING MEMBRANE, which claims the benefit of U.S. provisional patent application No. 61/533,999, filed on Sep. 13, 2011, and titled "Roofing Membrane." U.S. provisional patent application No. 61/533,999 is incorporated herein by reference in its entirety.

FIELD OF THE INVENTION

Various embodiments of a granule coated waterproof roofing membrane are described herein.

BACKGROUND OF THE INVENTION

A roof may have a steep-slope or a low-slope. Traditional tabbed or laminated shingles are typically used for steep-slope roofing applications. Traditional tabbed or laminated shingles are referred to as "water-shedding" products. That is, water that falls on a shingle on an upper portion of the roof runs down the shingle and onto an underlying, next lower shingle. The water runs down the shingles, until the water reaches the bottom of the steep roof.

As the slope of a roof decreases, more emphasis is placed on the need for waterproofing the roof covering, because less aid to physical movement of water is provided by the slope of the roof. Residential and commercial products are available for low-slope roofing applications. Most products used in residential low-slope roofing applications include two or more plies or layers to enhance long-term performance. A typical low-slope roofing product may have one or more underlayment or base sheets and a separate cap sheet. Typically, the separate cap sheets are similar to typical asphalt roofing shingles and may include a woven or non-woven fiber mat that is coated on both upper and lower surfaces with asphalt. The separate cap sheet may have a layer of roofing granules on the upper surface that is configured to match the roofing shingles of a nearby steep-slope roof. One or both of the base sheet and the separate cap sheet may be self-adhering.

Many low-slope roofing products used in commercial applications are non-asphalt based membranes that are installed on a low-slope roof using a variety of attachment means, such as with cold or hot applied adhesive materials, or with mechanical fasteners. The seams between portions of the membrane may be heat welded or glued. Typical commercial membranes are manufactured in solid colors, commonly white or black, and may be limestone covered. Other known low-slope roofing products include membranes with patterns printed on the visible surface, and membranes coated with paint or a reflective coating.

SUMMARY OF THE INVENTION

The present application describes various embodiments of a waterproof granule coated roofing membrane. One embodiment of the roofing membrane includes a membrane layer. An adhesive layer is bonded to a first side of the membrane layer and a layer of roofing granules is adhered to the first adhesive layer.

Other advantages of the roofing membrane will become apparent to those skilled in the art from the following detailed description, when read in view of the accompanying drawings.

DETAILED DESCRIPTION OF THE INVENTION

Figure 1:
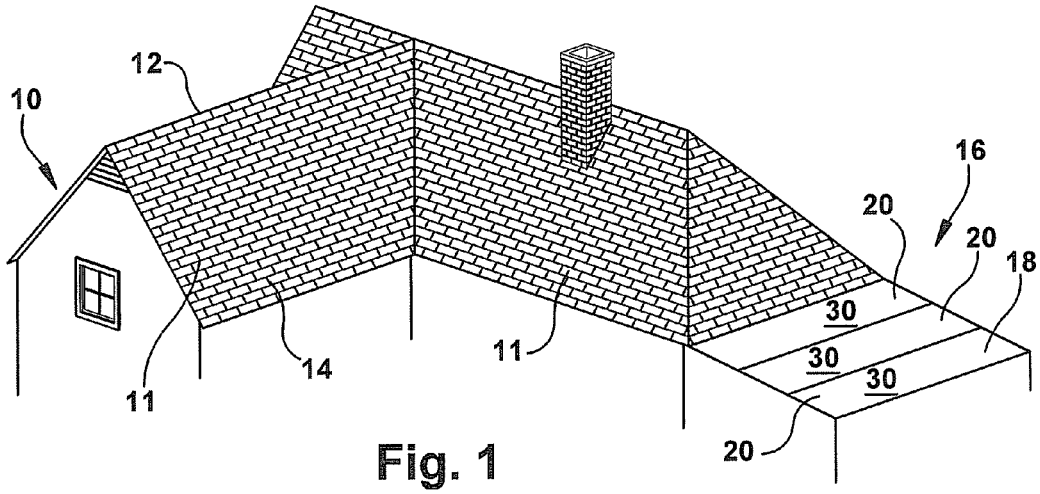
FIG. 1 is a perspective view of a building structure and an attached low-slope roof according to the invention.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

As used in this application, the phrase "low-slope roof" is defined as a roof having a slope or pitch within the range of from about ¼:12 to about 4:12. Proper roof design requires some slope to promote drainage and prevent water ponding. As used in this application, the phrase "steep-slope roof" is defined as a roof having a slope or pitch greater than 4:12. Typical steep-slope roofs have a slope or pitch from about 4:12 to about 18:12, however, some steep-slope roofs may be even steeper. Details of typical steep-slope roofs can be found in the Asphalt Roofing Residential Manual, 2006, published by The Asphalt Roofing Manufacturers Association (ARMA). Unless otherwise indicated, the roofing materials described herein can be used in low-slope applications and steep-slope applications.

As used in this application, the terms "pitch" and "slope" in the context of a building structure roof are defined as the amount of rise a roof has compared to the horizontal measurement of the roof. A roof having a slope of 4:12 therefore means that for every 12 inches of horizontal measurement, or roof run, the vertical measurement, or roof rise is 4 inches.

Referring now to FIG. 1, a building structure 10 is shown having a steep roof 11 with a shingle-based roofing system 12. While the building structure 10 illustrated in FIG. 1 is a residential home, it will be understood that the building structure 10 may be any type of structure, such as a garage, church, arena, an industrial or commercial building, having a steep-slope roof 11 with a shingle-based roofing system 12 having a plurality of shingles 14. A low-slope roof 16 extends from the building structure 10 and may cover an open or enclosed patio, garage, or carport, for example. The low-slope roof 16 includes a low-slope roof deck 18.

Figure 2:
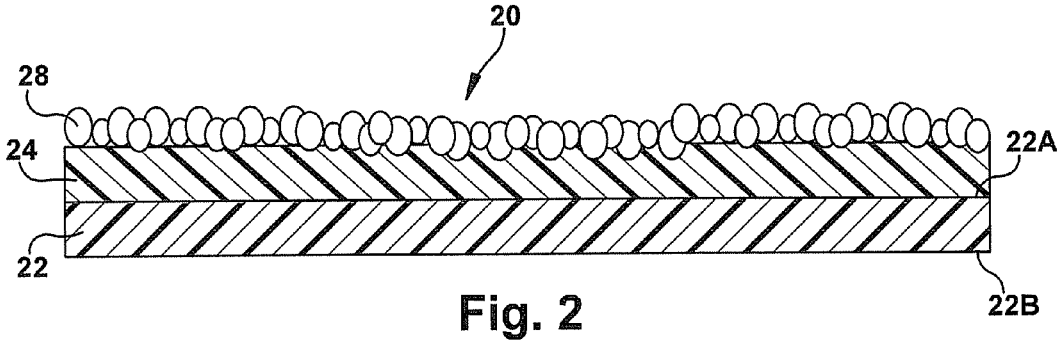
FIG. 2 is an enlarged cross-sectional view of an exemplary embodiment of a granule-coated waterproof roofing membrane.

FIG. 2 illustrates an exemplary embodiment of a granule-coated roofing membrane 20. In the example illustrated by FIG. 2, the granule-coated roofing membrane 20 includes a waterproof membrane layer 22, an adhesive 24, and a layer of roofing granules 28. The adhesive 24 adheres to the waterproof membrane layer 22. The layer of roofing granules 28 is adhered to the waterproof membrane layer 22 by the adhesive 24.

The waterproof membrane layers described in this application may be made from a wide variety of different materials. For example, the waterproof membrane 22 may be any membrane that prevents water on a top side 22A of the membrane from passing through the membrane 22 to a bottom side 22B of the membrane. That is, the waterproof membrane layer 22 may be made from any water impermeable material. Examples of materials that the waterproof membrane layer 22 can be made from include, but are not limited to, any thermoset material or any thermoplastic material. Examples of thermoset materials that can be used include, but are not limited to, EPDM (ethylene, propylene, diene monomer rubber), CSPE (chlorosulfonated polyethylene), such as DuPont® Hypalon®, CR (Neoprene), ECR (Epoxy Coated Rebar). Examples of thermoplastic materials that can be used include, but are not limited to, polyester, nylon, TPO (Thermoplastic Polyolefin), CPA (Copolymer Alloy), PVC (polyvinylchloride), EIP (Ethylene Interpolymer), NBP (Nitrile Alloy), PIB (Polyisobutylene), and CPE (Chlorinated Polyethylene). The waterproof membrane can be made from any combination of thermoset and/or thermoplastic materials, including but not limited to, any combination of the thermoset and/or thermoplastic materials disclosed by this application. The waterproof membrane layer 22 may be formed as extruded sheets of any one or any combination of these materials. The material of the membrane layer 22 may have fire retardant properties, thereby enhancing the fire retardant properties of the granule-coated roofing membrane 20. In one exemplary embodiment, the membrane layer is made from a ketone ethylene ester resin, such as Dupont™ ELVALOY®, polyvinylchloride (PVC), or a combination of ketone ethylene ester and PVC.

The waterproof membrane layer 22 may be between about 1 and about 120 mils thick. In one exemplary embodiment, the waterproof membrane layer 22 is about 15-120 mils, such as between about 15 and about 80 mils or about 45-80 mils. In one exemplary embodiment, when the waterproof membrane layer 22 is between 1-15 mils, the waterproof membrane layer has a melting temperature that is greater than 350 degrees F.

Figure 3:
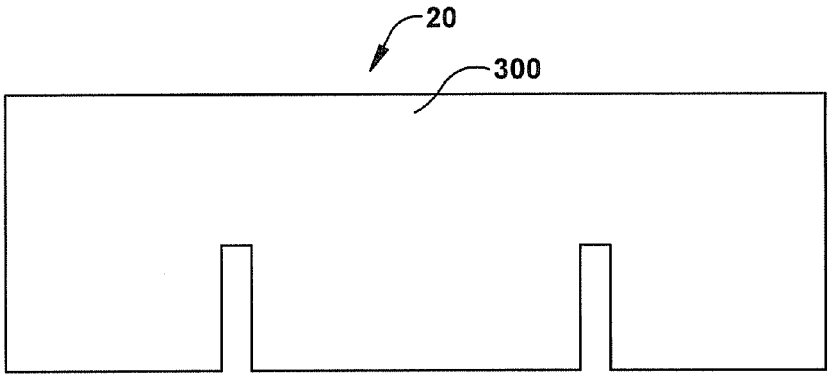
FIG. 3 is a plan view of an exemplary embodiment of a granule coated waterproof roofing membrane having the shape of a three-tab shingle.

The waterproof membrane layer 22 may have a wide variety of different configurations. Referring to FIG. 1, a low-slope roof 16 may use large, rectangular waterproof granule coated membrane sheets 30. For a steep slope roof 11, the waterproof membrane layer 22 may have a smaller rectangular form or may be cut to provide the appearance of a traditional shingle 14. For example, FIG. 3 illustrates that the waterproof membrane layer 22 may be cut into the shape of a three-tab shingle 300. Such a waterproof membrane layer 300 may be used to construct granule coated roofing membranes 20 that provide substantially the same appearance as a shingle and can be installed in substantially the same manner as a shingle. Individual three-tab shingles 300 may be made with the waterproof membrane layer as illustrated by FIG. 3 or continuous/repeating three-tab shingles 300 may be provided in roll form.

The adhesives described in this application may take a wide variety of different forms. For example, the adhesive 24 may be any material capable of adhering the granules 28 to the waterproof membrane 22. Examples of materials that may be used as an adhesive include, but are not limited to, asphalt, polymer modified asphalt, butyl based adhesives, such as polyisobutylene, adhesives that cure by drying, such as solvent based adhesives and polymer dispersion adhesives, pressure sensitive adhesives, contact adhesives, hot melt adhesives, such as thermoplastic adhesives, and multi-component adhesives, such as acrylics, urethanes, and epoxies. Examples of multi-part adhesives include polyester resin-polyurethane resin, polyols-polyurethane resin, and acrylic polymers-polyurethane resins. When adhesives other than asphalt based adhesives are used, the adhesive may be dyed or otherwise processed to have the dark or black appearance of asphalt.

In one exemplary embodiment, the granule holding function of the adhesive layer 24 is provided by the waterproof membrane 22 itself, so that a separate adhesive layer is not required. For example, the waterproof membrane 22 may be heated to provide the waterproof membrane 22 with adhesive properties. Granules 28 can then be applied to the waterproof membrane. For example, the granules can be pressed into the adhesive. In another exemplary embodiment, the granules 28 are heated and pressed into the surface of the membrane 22. The heat from the granules 28 causes the waterproof membrane to melt or partially melt around the granules. In either case (membrane heating and/or granule heating), when the waterproof membrane 22 and/or the granules 28 cool, the granules 28 are permanently adhered to the membrane 22.

When the adhesive(s) disclosed in this application is an asphalt, the asphalt may be any asphalt-based material capable of adhering the granules 28 to the waterproof membrane 22 and/or capable of adhering the waterproof membrane 22 to a roof deck. In one exemplary embodiment, the asphalt is not modified with a polymer. In another exemplary embodiment, the asphalt is polymer modified asphalt. The asphalt may be modified by any suitable polymer, such as with styrene-butadiene-styrene (SBS), or styrene-isoprene-styrene (SIS). Examples of polymer modified asphalts are disclosed in U.S. Pat. No. 4,738,884 to Algrim et al. and U.S. Pat. No. 3,770,559, to Jackson the contents of which are incorporated herein by reference in their entirety. The asphalt used as the adhesive layer 24 may include various types or grades of asphalt, including flux, paving grade asphalt blends, propane washed asphalt, oxidized asphalts, and/or blends thereof. Effective blends of asphalt or bituminous materials are understood by those of ordinary skill in the art. These polymer modified asphalts may also include fillers. For example, the first adhesive layer 24 may include a filler of finely ground inorganic particulate matter, such as ground limestone, dolomite or silica, talc, sand, or calcium carbonate in an amount within the range of from about 25 percent to about 60 percent by weight of the first adhesive layer 24. Other materials suitable for use in an asphalt adhesive layer include process oils, tackifying resins, and other types of natural and synthetic rubber materials and thermoplastic polymers. Additionally, recycled roof tear-off materials, such as shingles, may be included in the asphalt adhesive. Recycled shingles may be processed in a wide variety of different ways to allow the material to be used in the adhesive. For example, tear off shingles may be processed as described in U.S. Patent Application 20110049275 to Zickell, to be used as a filler or an additive to the adhesive layer 24.

The adhesive layer 24 can be applied to the substrate 22 in a wide variety of different manners. In one exemplary embodiment, the adhesive layer may be between about 10 mils and about 100 mils or may be between about 15 mils and about 100 mils. The adhesive layer 24 may be applied to the entire upper surface 22A of the substrate 22 or only portions of the substrate. For example, the adhesive layer 24 may be applied to the area of the roofing material 20 that is exposed (i.e. the area that is not covered by other roofing material 20) and the adhesive layer 24 is not applied to the unexposed area (i.e. the area that is covered by other roofing material 20) or a portion of the unexposed area.

The roofing granules 28 may take a wide variety of different forms. In an exemplary embodiment, the roofing granules are dense, non-porous, UV-ray resistant, natural mineral particles coated in ceramic. The mineral particles may be silica rich minerals, such as rhyolite. Colored pigments may be applied to the base mineral by the ceramic coating that covers the granule. Roofing granules are available from 3M.

Any desired color, color blend, or combinations of colors and color blends of granules may be applied to define the layer of roofing granules 28. Advantageously, the granule-coated roofing membrane 20 may be manufactured to include colors and/or color blends of granules 28 that match, coordinate with, and/or complement the colors and/or color blends of the granules of the roofing shingles 14 installed on other portions of the building structure 10. For example, in one exemplary embodiment, the traditional shingles 14 are used on one portion of the building and the roofing material 20 is used on another portion of the building. By matching, coordinating with, and/or complementing the colors and/or color blends of the granules of the roofing shingles 14 with the granule-coated roofing material 20, an aesthetically pleasing appearance is achieved.

The waterproof membrane 22 provides flexibility in the selection of the granules 28 that may be used on the roofing material 20. Since the waterproof membrane provides the waterproofing and/or water shedding feature of the roofing material 20, the granules 28 may be selected to provide an aesthetically pleasing appearance without needing to meet the high performance requirements of granules of conventional shingles. For example, granules that are not typically used in roofing applications may be used.

As is mentioned above, traditional roofing granules are UV-ray resistant/UV opaque and have a ceramic coating. The UV resistance and the ceramic coating protects the asphalt of traditional shingles. If a waterproof membrane 22 and/or adhesive 24 do not need to be protected from UV rays, granules that are not traditionally used in roofing applications can be used. For example, granules that are not UV opaque and/or that are not coated in ceramic can be used. Examples of granules that are not traditionally exposed in roofing applications that may be used with the waterproof membrane 22 include, but are not limited to uncoated mineral particles, such as rhyolite and other silica rich minerals, rock dust, and coal slag.

The roofing granules 28 may have a variety of different sizes. In one exemplary embodiment, the size and/or shape of the granules 28 used on the roofing material 20 is different than the size and/or shape of the granules used of the corresponding conventional shingles 14. For example, the average size of the granules used on the roofing material 20 are about 10%, about 20%, about 30%, about 40%, about 50%, or between 10% and 50% larger or smaller than the average size of the granules of a corresponding conventional shingle.

Figure 4A:
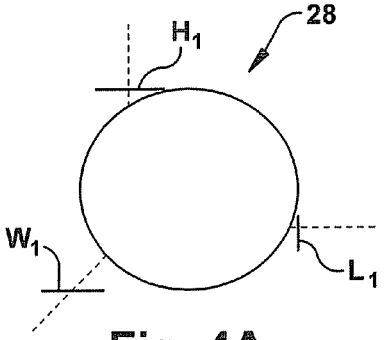
FIGS. 4A and 4B illustrate exemplary embodiments of granules having different shapes.
Figure 4B:
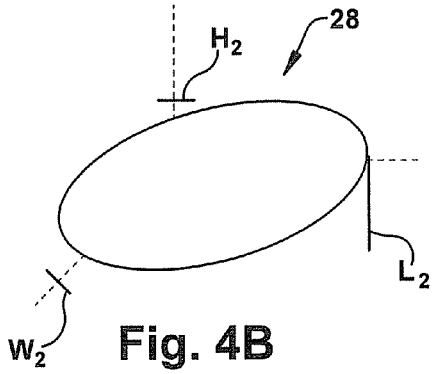

Referring to FIG. 4A, the granules of a traditional shingle may have roughly equivalent length $L_1$, height $H_1$, and width $W_1$ dimensions. Referring to FIG. 4B, the granules 28 of the roofing material 20 may be selected to have a shorter height dimension $H_2$ vs. a wider width dimension $W_2$ and/or a longer length dimension $L_2$ (i.e. flatter granule). This allows fewer granules and less granule material to be used on the roofing material 20 as compared to a traditional shingle 14. For example, a ratio R of granule height H over granule width W and granule length L:

$$R=H/(W+L)$$

of the granules for the roofing material 20 may be significantly lower than the ratio for the granules of a traditional shingle. For example, the average ratio $R_2$ of the granules used on the roofing material 20 are about 10%, about 20%, about 30%, about 40%, about 50%, or between 10% and 50% less than the ratio $R_1$ for the granules of a corresponding conventional shingle.

Roofing granules used to define the layer of roofing granules 28 may be applied to the first adhesive layer 24 by any desired method. Examples of methods and apparatus for applying roofing granules to an asphalt coated sheet are disclosed in U.S. Pat. No. 5,746,830 to Burton et al., U.S. Pat. No. 6,228,422 to White et al., U.S. Pat. No. 6,610,147 to Aschenbeck, and U.S. Pat. No. 7,163,716 to Aschenbeck, each of which is incorporated herein by reference in their entirety.

The layer of roofing granules 28 can be applied to the substrate 22 in a wide variety of different manners. The layer of roofing granules 28 may be applied to the adhesive coating 24 or only portions of the adhesive coating. For example, the layer of granules may be applied to the area of the roofing material 20 that is exposed (i.e. the area that is not covered by other roofing material 20) and the layer of granules is not applied to the unexposed area (i.e. the area that is covered by other roofing material 20) or a portion of the unexposed area.

Figure 5:
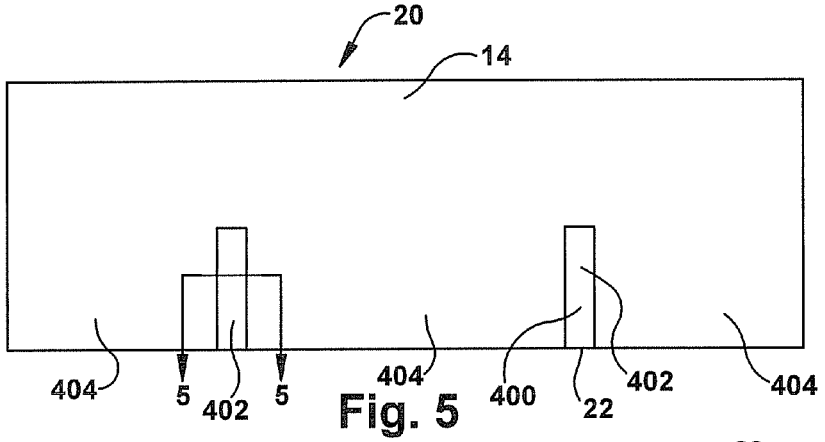
FIG. 5 is a plan view of an exemplary embodiment of a rectangular granule coated waterproof roofing membrane having an appearance of a three-tab shingle.
Figure 5A:
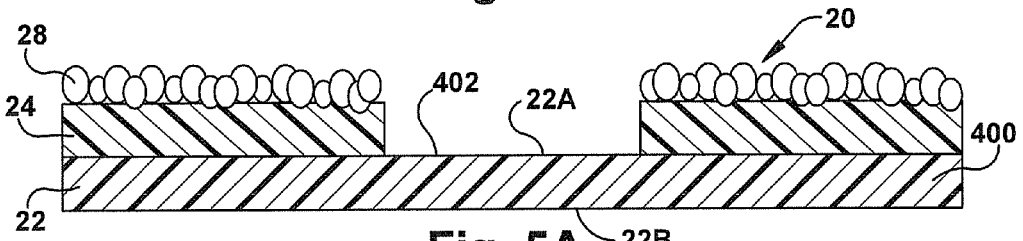
FIG. 5A is a sectional view illustrating one embodiment of the rectangular granule coated waterproof roofing membrane illustrated by FIG. 5.
Figure 5B:
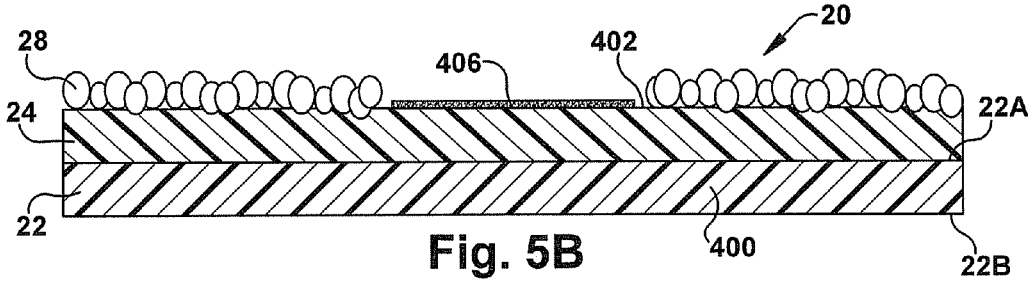
FIG. 5B is a sectional view illustrating another embodiment of the rectangular granule coated waterproof roofing membrane illustrated by FIG. 5.

The layer of granules 28 can be applied in a manner that provides the roofing material 20 with a desired appearance. For example, referring to FIG. 5 the adhesive 24 and/or the roofing granules 28 can be applied to an uncut rectangular substrate 400 to provide the appearance of a traditional three-tab shingle. Areas 402 having the appearance of the cuts between tabs 404 can be provided by applying darker or black granules 28 in the areas 402, masking, applying mineral dust, or otherwise preventing the layer of granules 28 from being applied in the areas (See FIG. 5B), and/or masking, applying mineral dust, or otherwise preventing the granules and adhesive 24 from being provided in the areas 402 (See FIG. 5A). In one embodiment, the adhesive 24 may be applied to the entire tab region 404 of the roofing material and a mineral dust 406 or other material that prevents adhesion of the granules is deposited in the areas 400 (See FIG. 5B). A wide variety of different appearances can be provided by the roofing material 20, without cutting a rectangular shaped substrate 22, by controlling the application of the adhesive 24 and/or granules.

Figure 2A:
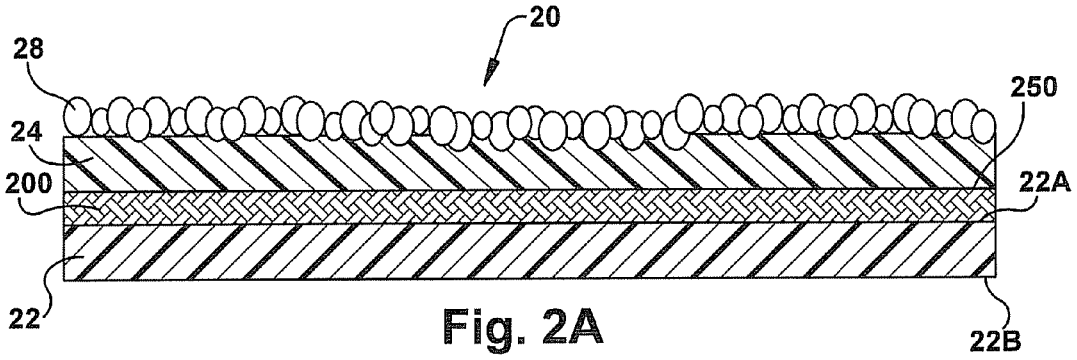
FIGS. 2A-2C are enlarged cross-sectional views of exemplary embodiments of reinforced granule-coated waterproof roofing membranes.
Figure 2B:
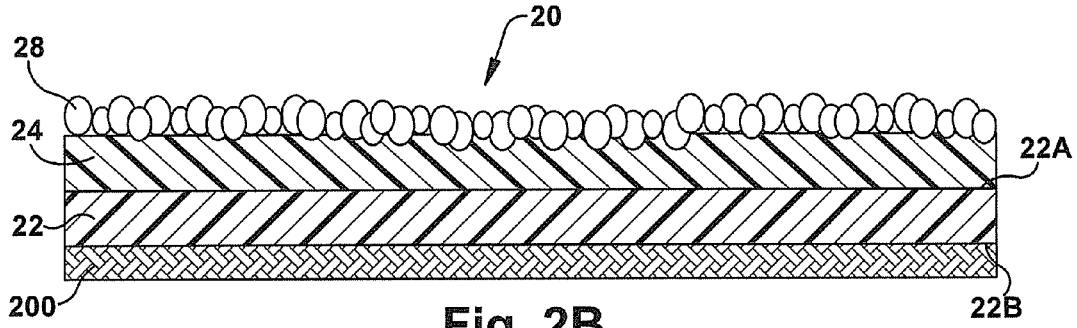
Figure 2C:
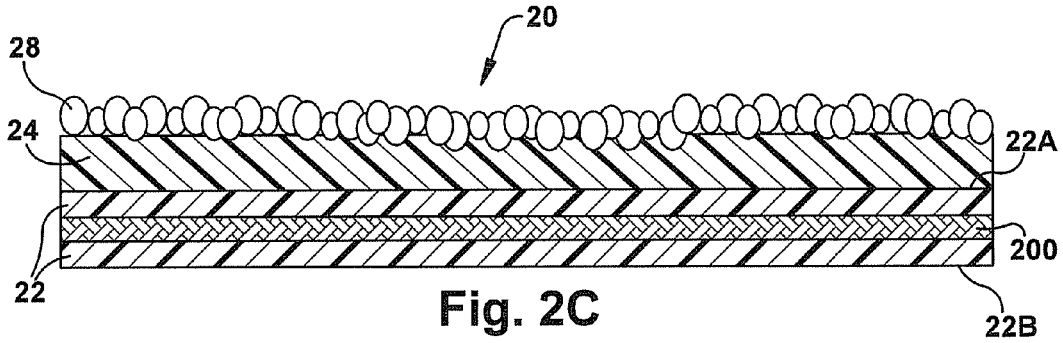

Referring to FIGS. 2A-2C, in one exemplary embodiment, the physical properties of the membrane layer 22 may be enhanced by a reinforcing layer 200. The membrane layer 22 may be applied to the reinforcing layer 200 or the reinforcing layer 200 may be applied to the membrane layer 22 in a wide variety of different ways. In FIG. 2A, the reinforcing layer 200 is on the top surface 22A of the waterproof membrane layer 22. In FIG. 2B, the waterproof membrane layer 22 is on the reinforcing layer 200. In FIG. 2C, the reinforcing layer 200 is inside the waterproof membrane layer 22 or between two waterproof membrane layers.

The reinforcing layer 200 can be made from a wide variety of different materials. Any material that increases the physical properties, such as tear strength, tensile strength, and/or puncture resistance of the granule coated waterproof membrane 20 can be used. Examples of suitable materials that the reinforcing layer 200 can be made from include, but are not limited to, woven, knitted, or nonwoven glass, polyester, or combinations thereof. An example of a knitted material is a weft inserted fabric. The reinforcing layer 200 can be applied to the waterproof membrane layer 22 in a variety of different ways. For example, the reinforcing layer 200 can be fused to the waterproof membrane layer 22 or an adhesive, such as a polymeric adhesive, can be used to adhere the reinforcing layer 200 to the waterproof membrane layer 22.

The combination of the reinforcing material and material of the waterproof membrane 22 provides improved breaking strength, tearing strength, and puncture resistance. Additionally, the material of the membrane layer 22 and/or the reinforcing layer 200 may have fire retardant properties.

In one exemplary embodiment, the waterproof membrane layer 22 and the reinforcing layer 200 are configured to have a much higher "nail pull through" force than a conventional shingle 14. Shingles are typically secured to a roof deck with nails. The nail pull through force is the amount of force required to pull the shingle material over the head of the nail. ASTM D3462 requires conventional shingles to pass a minimum of 20lbf nail pull test. The nail pull through force for some conventional shingles with an unreinforced nail zone is about 40lbf. In one exemplary embodiment, the nail pull through force for a granule coated substrate 20 having a woven or knitted reinforcement layer 200 on a rear surface 22A of the membrane layer is over 100lbf, may be over 140lbf, and may be over 200lbf. In exemplary embodiments, the nail pull through force for a granule coated substrate 20 having a woven or knitted reinforcement layer 200 is over 7 times, over 8 times, over 9 times, or over ten times the nail pull through force for a conventional shingle with an unreinforced nail zone.

In one exemplary embodiment, the waterproof membrane layer 22 and the reinforcing layer 200 are configured to have a much higher puncture resistance than a conventional shingle 14. The puncture resistance for some conventional low-slope roofing materials is about 20 to 50lbf. In one exemplary embodiment, the puncture resistance for a granule coated substrate 20 having a woven or knitted reinforcement layer 200 is over 175lbf, such as from about 175lbf to about 250lbf. In exemplary embodiments, the puncture resistance for a granule coated substrate 20 having a woven or knitted reinforcement layer is about five times to about ten times the puncture resistance for a conventional low-slope roofing material.

In one embodiment, the membrane layer 22 is the FIBERTITE® membrane product manufactured by Seaman Corporation of Wooster, Ohio. (See http://fibertite.com/home.php, accessed Sep. 2, 2011). In this embodiment, the membrane consists of a woven or knitted fabric layer coated with an adhesive and a proprietary blend of DuPont ELVALOY® ketone ethylene ester (KEE) resin. In this alternate embodiment, the resin may be applied to one or both sides; i.e., the broad faces, of the woven or knitted fabric layer and may impregnate the woven or knitted fabric layer.

Figure 2D:
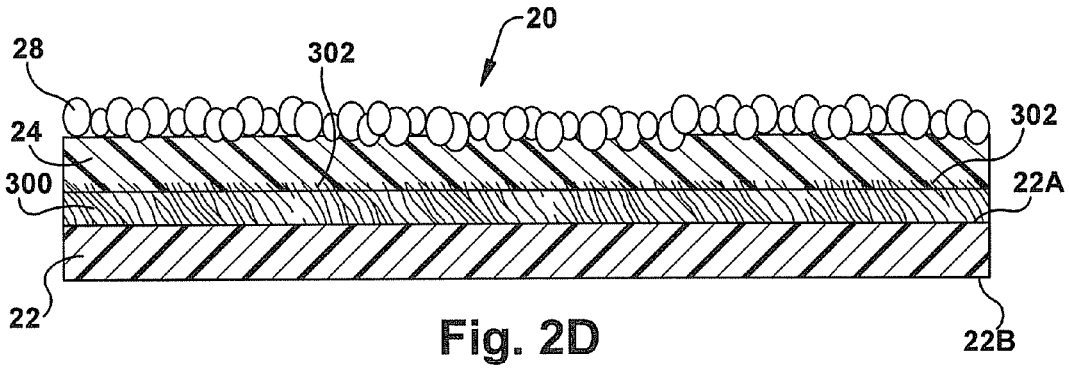
FIG. 2D is an enlarged cross-sectional view of an exemplary embodiment of a granule-coated waterproof roofing membrane with an adhesion enhancing layer that enhances the adhesion between an adhesive layer and a waterproof membrane layer.

Referring to FIG. 2D, in one exemplary embodiment, the adhesion between the membrane layer 22 and the adhesive 24 may be enhanced by an adhesion promoting layer 300. The adhesion promoting layer 300 can take a wide variety of different forms. The adhesion promoting layer 300 provides a textured multi-dimensional surface which optimizes adhesion with asphalt or other adhesive 24 for the exposed surface of the granule coated waterproof membrane 20. In an exemplary embodiment, the adhesion promoting layer 300 is bonded to the membrane layer 22. The adhesion promoting layer 300 can be bonded to the waterproof membrane layer 22 in a variety of different ways. For example, the adhesion promoting layer 300 can be fused to the waterproof membrane layer 22 or an adhesive, such as a polymeric adhesive, can be used to adhere the adhesion promoting layer 300 to the waterproof membrane layer 22. The illustrated adhesion promoting layer 300 includes discrete projections 302, strands, or other surfaces that extend into the adhesive 24 to promote a strong bond between adhesion promoting layer 300 and the adhesive 24.

Examples of materials that can be used for the adhesion promoting layer 300 include, but are not limited to felt material, such as polyester non-woven fleece, texturized yarns, bare yarn, and any other material that provides a textured surface for better mechanical adhesion of the adhesive to the membrane 22.

Figure 2E:
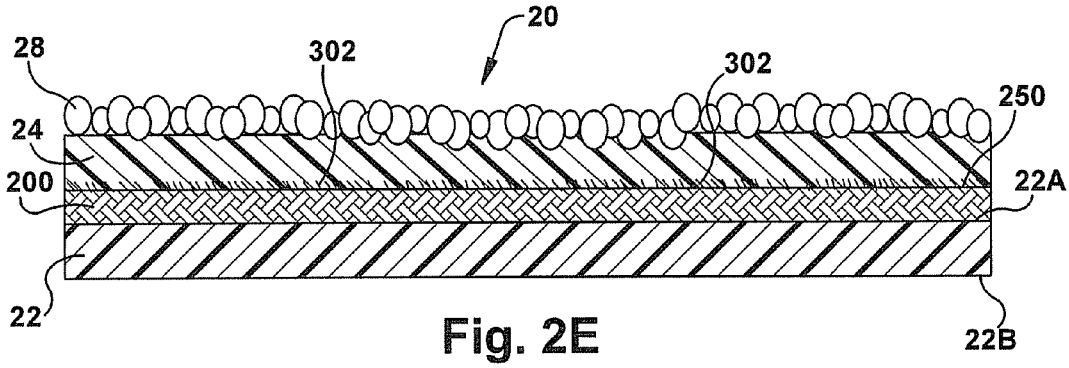
FIG. 2E is an enlarged cross-sectional view of an exemplary embodiment of a granule-coated waterproof roofing membrane with a single layer that both enhances the adhesion between an adhesive layer and a waterproof membrane layer and reinforces the waterproof membrane layer.

Referring to FIG. 2E, in one exemplary embodiment the functions of the adhesion promoting layer 300 and the reinforcing layer 200 may be provided by a single layer. For example, a surface 250 of one of the reinforcing layers 200 described above may be treated or processed to provide discrete projections 302 or strands that promote adhesion. Further, a non-woven reinforcement layer 200 may already have characteristics that also make the layer a good adhesion promoting layer. A woven or knitted reinforcement layer 200 have the surface 250 that contacts the adhesive 24 processed to provide adhesion promoting properties. For example, the surface 250 of the woven or knitted reinforcement layer may be initially formed with extending projections or strands, or may be abraded, scuffed, grated or cut to provide projections or strands that promote adhesion.

The reinforcement layer 200 may include strands of textured yarns, such as textured polyester yarns. Air textured yarn is a yarn that has been processed to introduce durable crimps, coils, loops or other fine distortions along the length of the fibers, thereby altering the surface texture and topography of the reinforcement layer fabric. The texturing process may include one or more of the following processes: twisting yarn, heat-setting and then untwisting; passing the yarn through a heated "stuffer box"; passing the heating yarn over a knife edge; passing the heated yarn between a pair of geared wheels or some similar device; and knitting the yarn into a fabric reinforcement layer, heat-setting, then unraveling the yarn. The use of air textured yarn in the reinforcement layer 200 improves adhesion of asphalt, or other adhesive 24 to the waterproof membrane 22. As such, a woven or knitted reinforcement layer may be selected to both promote adhesion and reinforce the membrane layer 22.

In one exemplary embodiment, the waterproof membrane 22 may be processed to perform the functions of the adhesion promoting layer 300 and thereby eliminate an adhesion promoting layer made from discrete materials. For example, a surface 22A or 22B of the waterproof membrane 22 may be treated or processed to provide discrete projections or strands that promote adhesion. For example, a surface of the waterproof membrane layer may be initially formed with projections or strands, or may be abraded, scuffed, grated or cut to provide projections or strands that promote adhesion.

The layers of granules 28, adhesive 24, waterproof membranes 22, reinforcement layers 200, and/or adhesion promoting layers 300 disclosed herein can be combined in a variety of different ways to construct many different granule coated waterproof membranes 20. FIGS. 6-11 illustrate some of the possible configurations.

Figure 6:
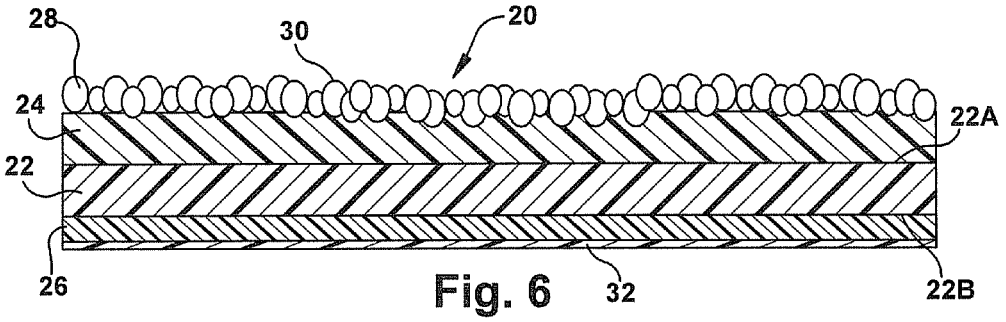
FIG. 6 is an enlarged cross-sectional view of an exemplary embodiment of a granule-coated waterproof roofing membrane.

In FIG. 6, a first adhesive layer 24 is applied to a first side 22A of the membrane layer 22 (upwardly facing surface when installed on a roof). A second adhesive layer 26 is applied to a second side 22B of the membrane layer 22 (downwardly facing surface when installed on a roof). A layer of roofing granules 28 is applied to the first adhesive layer 24 and defines a granule-coated surface 30.

A release layer 32 is applied to the second adhesive layer 26. The release layer may take a wide variety of different forms. The release layer 32 can be any material that removably adheres to the second adhesive layer 26. Examples of acceptable materials for the release layer 32 include, but are not limited to, plastic materials, such as plastic films (i.e. polyolefin film, polypropelyne film, etc.), coated materials, such as paper, plastic or other material coated with silicone or other release material. The release layer 32 prevents the granule-coated roofing membrane 20 from adhering to itself when arranged in a roll 34 (See FIG. 18), as described below or when sheets of the granule coated roofing membrane 22 are stacked. The release layer 32 may be removed by a roof installer so that the bottom surface, or surface opposite the granule-coated surface 30 of granule-coated roofing membrane 20, will adhere to the low-slope roof deck 18 or steep-slope roof as shown in FIG. 1.

The second adhesive layer 26 may be identical to the first adhesive layer 24. In the embodiments disclosed herein, the second adhesive layer 26 is provided to adhere or bond the granule-coated roofing membrane 20 to the low-slope roof deck 18 or the steep-slope roof 11. Alternatively, the second adhesive layer 26 may be a softer asphalt material relative to the asphalt material of the first adhesive layer 24. The second adhesive layer 26 may also contain more light oil relative to the first adhesive layer 24, therefore making the second adhesive layer 26 softer, more flexible, and have stronger or better adhesion properties than the first adhesive layer 24. One method of applying a relatively non-adhesive asphaltic material and an adhesive asphalt coating to a woven or non-woven fibrous mat is disclosed in U.S. Pat. No. 6,296,912 to Zickell, which is incorporated herein by reference in its entirety.

It will be understood that the second adhesive layer 26 is not required and that the granule-coated roofing membrane 20 may be manufactured without the second adhesive layer 26. In an embodiment without the second adhesive layer 26, the granule-coated roofing membrane 20 may be attached to the low-slope roof deck 18 or steep-slope roof deck, or any layer of material intermediate the low-slope roof deck 18 or steep-slope roof deck and the granule-coated roofing membrane 20, by any desired means. For example, the granule-coated roofing membrane 20 may be attached to the low-slope roof deck 18 with an adhesive applied to any one or more of the low-slope roof deck 18, the membrane layer 22, and an intermediate layer of material. The granule-coated roofing membrane 20 may also be attached to the low-slope roof deck 18 or steep-slope roof deck with mechanical fasteners.

Figure 7A:
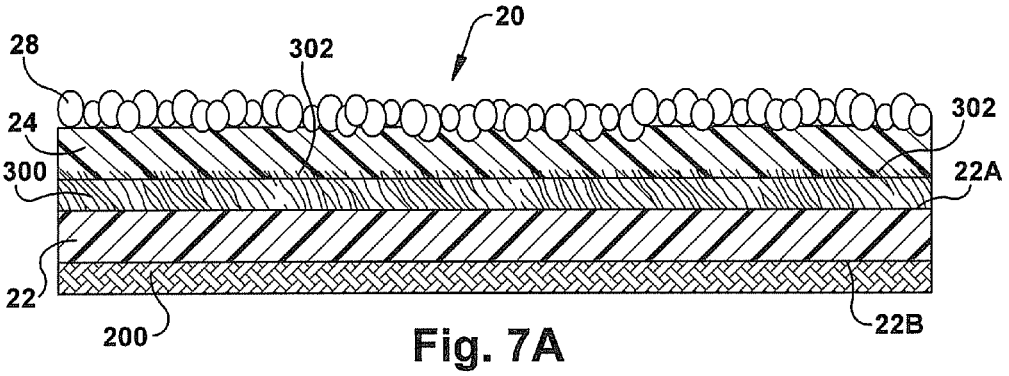
FIGS. 7A-7D are enlarged cross-sectional views of exemplary embodiments of granule-coated waterproof roofing membranes.
Figure 7B:
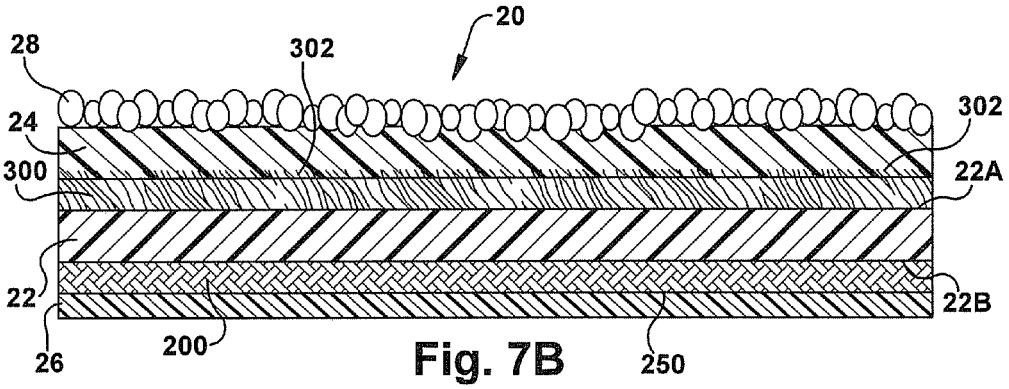
Figure 7C:
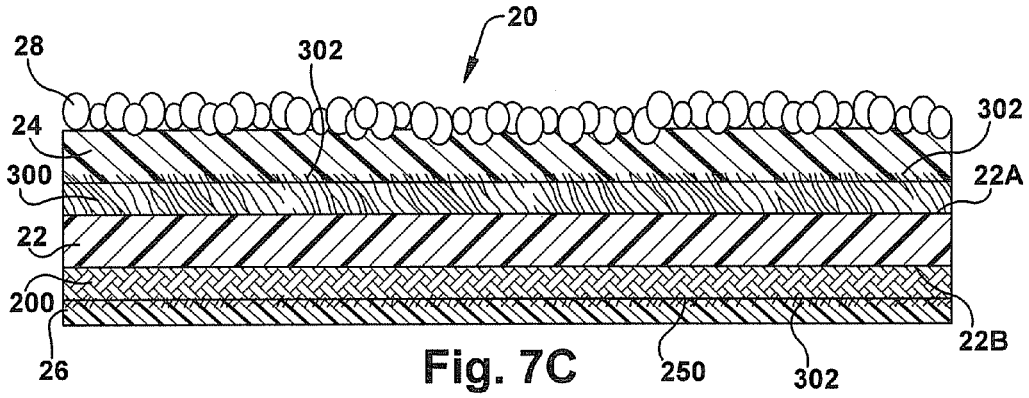
Figure 7D:
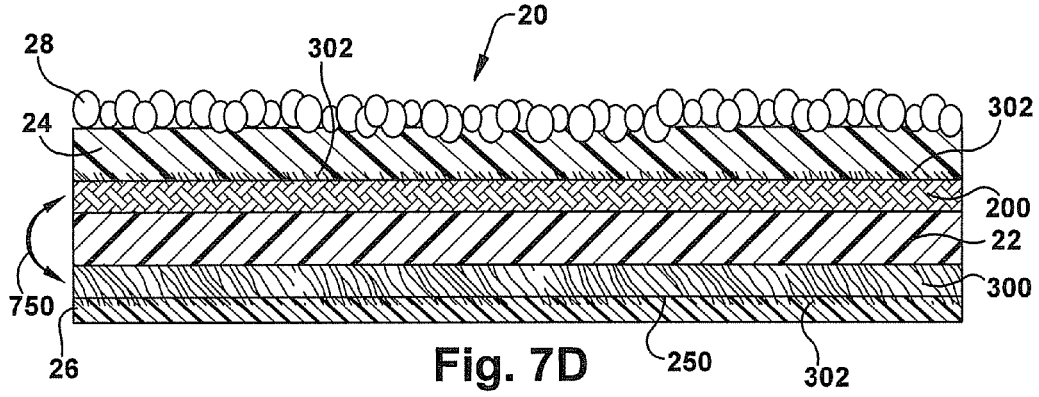

In the example illustrated by FIGS. 7A-7D, the granule coated waterproof membrane 20 includes a layer of granules 28, a first adhesive layer 24, such as a first asphalt adhesive layer, an adhesion promoting layer 300, a waterproof membrane 22, and a reinforcement layer 200. In the example illustrated by FIG. 7B, the granule coated waterproof membrane 20 also includes a second adhesive layer 26, such as a second asphalt adhesive layer. Referring to FIG. 7C, in an exemplary embodiment, the surface 250 of the reinforcement layer 200 is configured to promote adhesion of the reinforcement layer 200 to the second adhesive layer 26. For example, in FIG. 7C the surface 250 is illustrated as having strands or projections 302. FIG. 7D is an embodiment that is similar to the embodiment of FIG. 7C, except the adhesion promoting layer 300, the waterproof membrane 22, and the reinforcement layer 200 are flipped. That is, in the FIG. 7C embodiment, the reinforcement layer 200 is on top of the waterproof membrane 22 and the adhesion promoting layer is on the bottom of the waterproof membrane 22.

Figure 8:
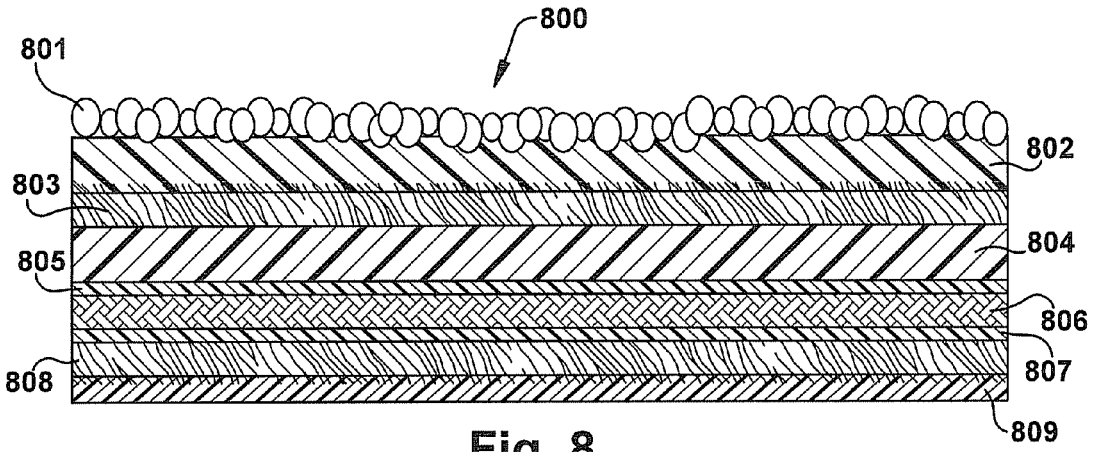
FIG. 8 is an enlarged cross-sectional view of an exemplary embodiment of a granule-coated waterproof roofing membrane.

FIG. 8 illustrates exemplary embodiments of self adhering, waterproof, granule coated roofing membranes 800. The following is a description of the different layers illustrated by FIG. 8:

801—Roofing Granules, such as the roofing granules 28 described herein.

802—Adhesive, such as the layer of adhesive 24 described herein.

803—Adhesion promoting material, such as the adhesion promoting layer 300 described herein.

804—Waterproof membrane material, such as the waterproof membrane material 22 described herein.

806—Reinforcement material, such as the reinforcement layer 200 described herein.

805—Adhesive, such as a polymer adhesive, which may be a polyvinylchloride adhesive, for adhering the layer 806 to the layer 804.

808—Adhesion promoting material, such as the adhesion promoting layer 300 described herein.

807—Adhesive, such as a polymer adhesive, which may be a polyvinylchloride adhesive, for adhering the layer 808 to the layer 806.

809—Adhesive, such as the layer of adhesive 26 described herein.

Any combination of the layers illustrated by FIG. 8 can be used to make a variety of different self adhering, waterproof, granule coated roofing membranes 800. The rows of the following table identify some of the possible combinations. An "X" in a cell of each row indicates the presence of each layer in the example indicated by the row. A cell without an "X" indicates that the layer is not included in the example indicated by the row.

| Layer 801 | Layer 802 | Layer 803 | Layer 804 | Layer 805 | Layer 806 | Layer 807 | Layer 808 | Layer 809 |
|---|---|---|---|---|---|---|---|---|
| X | X | X | X | X | X | X | X | X |
| X | X | | X | X | X | X | X | X |
| X | X | X | X | X | X | X | | X |

-continued

| Layer 801 | Layer 802 | Layer 803 | Layer 804 | Layer 805 | Layer 806 | Layer 807 | Layer 808 | Layer 809 |
|---|---|---|---|---|---|---|---|---|
| X | X | | X | X | X | X | | X |
| X | X | X | X | X | X | | X | X |
| X | X | X | X | X | X | | | X |
| X | X | | X | X | X | | X | X |
| X | X | | X | X | X | | | X |

Figure 9:
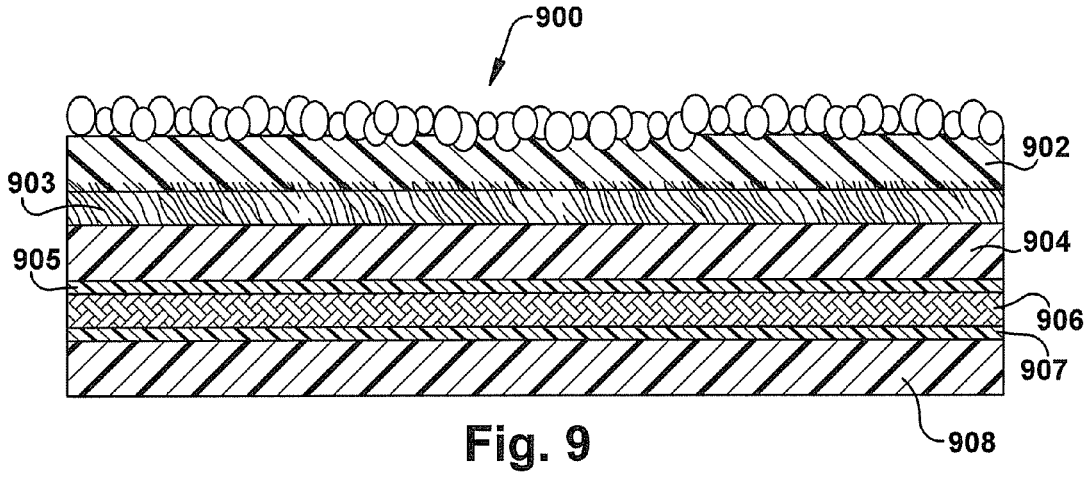
FIG. 9 is an enlarged cross-sectional view of an exemplary embodiment of a granule-coated waterproof roofing membrane.

FIG. 9 illustrates exemplary embodiments of fastener (for example, nails) applied, waterproof, granule coated roofing membranes 900. The following is a description of the different layers illustrated by FIG. 9:

901—Roofing Granules, such as the roofing granules 28 described herein.

902—Adhesive, such as the layer of adhesive 24 described herein.

903—Adhesion promoting material, such as the adhesion promoting layer 300 described herein.

904—Waterproof membrane material, such as the waterproof membrane material 22 described herein.

906—Reinforcement material, such as the reinforcement layer 200 described herein.

905—Adhesive, such as a polymer adhesive, which may be a polyvinylchloride adhesive, for adhering the layer 906 to the layer 904.

908—Waterproof membrane material, such as the waterproof membrane material 22 described herein.

907—Adhesive, such as a polymer adhesive, which may be a polyvinylchloride adhesive, for adhering the layer 908 to the layer 906.

Any combination of the layers illustrated by FIG. 9 can be used to make a variety of different fastening, waterproof, granule coated roofing membranes 900. The rows of the following table identify some of the possible combinations. An "X" in a cell of each row indicates the presence of each layer in the example indicated by the row. A cell without an "X" indicates that the layer is not included in the example indicated by the row.

| Layer 901 | Layer 902 | Layer 903 | Layer 904 | Layer 905 | Layer 906 | Layer 907 | Layer 908 |
|---|---|---|---|---|---|---|---|
| X | X | X | X | X | X | X | X |
| X | X | | X | X | X | X | |
| X | X | | X | X | X | X | X |

Figure 10:
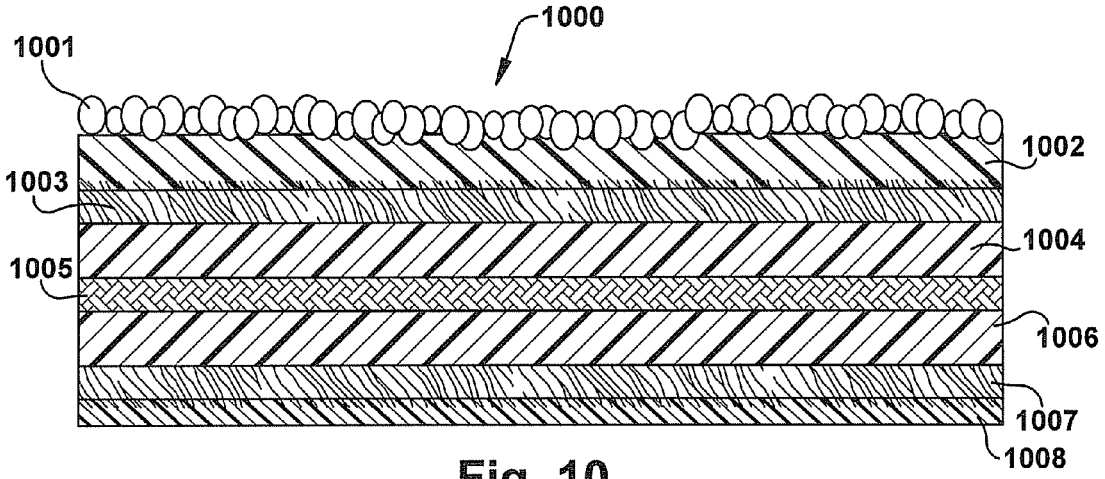
FIG. 10 is an enlarged cross-sectional view of an exemplary embodiment of a granule-coated waterproof roofing membrane.

FIG. 10 illustrates additional exemplary embodiments of self adhering, waterproof, granule coated roofing membranes 1000. The following is a description of the different layers illustrated by FIG. 10:

1001—Roofing Granules, such as the roofing granules 28 described herein.

1002—Adhesive, such as the layer of adhesive 24 described herein.

1003—Adhesion promoting material, such as the adhesion promoting layer 300 described herein.

1004—Waterproof membrane material, such as the waterproof membrane material 22 described herein.

1005—Reinforcement material, such as the reinforcement layer 200 described herein.

1006—Waterproof membrane material, such as the waterproof membrane material 22 described herein.

1007—Adhesion promoting material, such as the adhesion promoting layer 300 described herein.

1008—Adhesive, such as the layer of adhesive 26 described herein.

Any combination of the layers illustrated by FIG. 10 can be used to make a variety of different self adhering, waterproof, granule coated roofing membranes 1000. The rows of the following table identify some of the possible combinations. An "X" in a cell of each row indicates the presence of each layer in the example indicated by the row. In FIG. 10, it should be noted that when reinforcement layer 1005 is removed, the resulting depicted configuration implies a single membrane layer (i.e. layers 1004 and 1006 merge). A cell without an "X" indicates that the layer is not included in the example indicated by the row.

| Layer 1001 | Layer 1002 | Layer 1003 | Layer 1004 | Layer 1005 | Layer 1006 | Layer 1007 | Layer 1008 |
|---|---|---|---|---|---|---|---|
| X | X | X | X | X | X | X | X |
| X | X | X | X | | X | X | X |
| X | X | | X | X | X | X | X |
| X | X | | X | X | X | | X |
| X | X | X | X | X | X | | X |
| X | X | | X | | X | X | X |
| X | X | | X | | X | | X |
| X | X | X | X | | X | | X |

Figure 11:
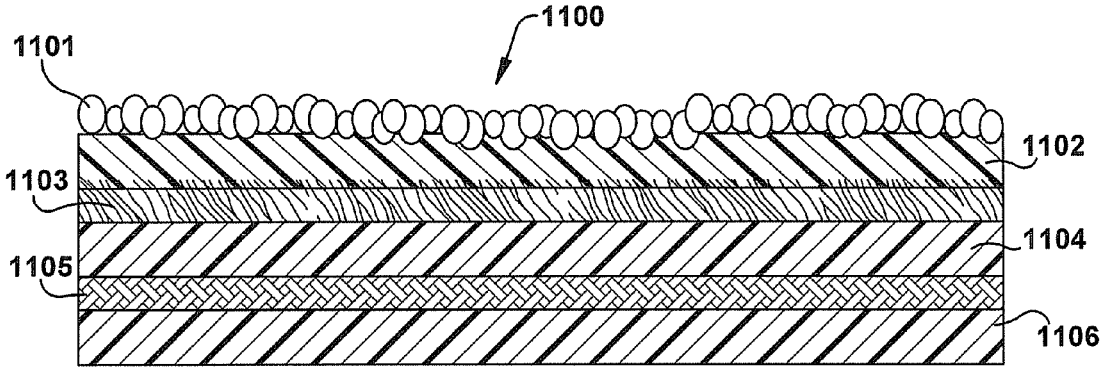
FIG. 11 is an enlarged cross-sectional view of an exemplary embodiment of a granule-coated waterproof roofing membrane.

FIG. 11 illustrates exemplary embodiments of fastener (for example, nails) applied, waterproof, granule coated roofing membranes 1100. The following is a description of the different layers illustrated by FIG. 11:

1101—Roofing Granules, such as the roofing granules 28 described herein.

1102—Adhesive, such as the layer of adhesive 24 described herein.

1103—Adhesion promoting material, such as the adhesion promoting layer 300 described herein.

1104—Waterproof membrane material, such as the waterproof membrane material 22 described herein.

1105—Reinforcement material, such as the reinforcement layer 200 described herein.

1106—Waterproof membrane material, such as the waterproof membrane material 22 described herein.

Any combination of the layers illustrated by FIG. 11 can be used to make a variety of different fastening, waterproof, granule coated roofing membranes 1100. The rows of the following table identify some of the possible combinations. An "X" in a cell of each row indicates the presence of each layer in the example indicated by the row. In FIG. 11, it should be noted that when reinforcement layer 1105 is removed, the resulting depicted configuration implies a single membrane layer (i.e. layers 1104 and 1106 merge). A cell without an "X" indicates that the layer is not included in the example indicated by the row.

| Layer 1101 | Layer 1102 | Layer 1103 | Layer 1104 | Layer 1105 | Layer 1106 |
|---|---|---|---|---|---|
| X | X | X | X | X | X |
| X | X | | X | X | X |
| X | X | X | X | | X |
| X | X | | X | | X |

The granule coated waterproof roofing membrane may be formed in a wide variety of different ways. In one exemplary embodiment, the granule-coated roofing membrane 20 is formed using a continuous manufacturing process. For example, the membrane layer 22 may be provided as a continuous sheet of material having a width W of about 3 feet (See FIG. 18). It will be understood that the membrane layer 22 may have any other desired width. The width W of the membrane layer 22 will be determined by the intended use of the finished granule-coated waterproof roofing membrane 20. For example, for residential building applications, the membrane layer 22 may have a width within the range of from about 2 feet to about 5 feet. For commercial building applications, the membrane layer 22 may have a much larger width, such as within the range of from about 6 feet to about 12 feet. The membrane layer 22 may have any other desired width, such as a width smaller than about 2 feet and a width larger than about 12 feet.

In a first step of the manufacturing process, the first adhesive layer 24 and the second adhesive layer 26 may be applied to the first side 22A and the second side 22B, respectively, of the membrane layer 22. As discussed above, one method of applying a relatively non-adhesive asphaltic material and an adhesive asphalt coating; i.e., the first adhesive layer 24 and the second adhesive layer 26, to a woven or non-woven fibrous mat is disclosed in U.S. Pat. No. 6,296,912 to Zickell. In an exemplary embodiment, the method disclosed by Zickell is adapted to apply the first adhesive layer 24 and the second adhesive layer 26 to the waterproof membrane 22.

Granules 28 may then be applied to the first adhesive layer 24, thereby defining the granule-coated roofing membrane 20. As discussed above, various examples of methods and apparatus for applying roofing granules to an asphalt coated sheet are disclosed in U.S. Pat. No. 5,746,830 to Burton et al., U.S. Pat. No. 6,228,422 to White et al., U.S. Pat. No. 6,610,147 to Aschenbeck, and U.S. Pat. No. 7,163,716 to Aschenbeck.

If desired, the release layer 32 may then be applied to the second adhesive layer 26. The release layer 32 may be applied to the second adhesive layer 26 before, after, or concurrently with the application of granules 28 to the first adhesive layer 24.

Figure 18:
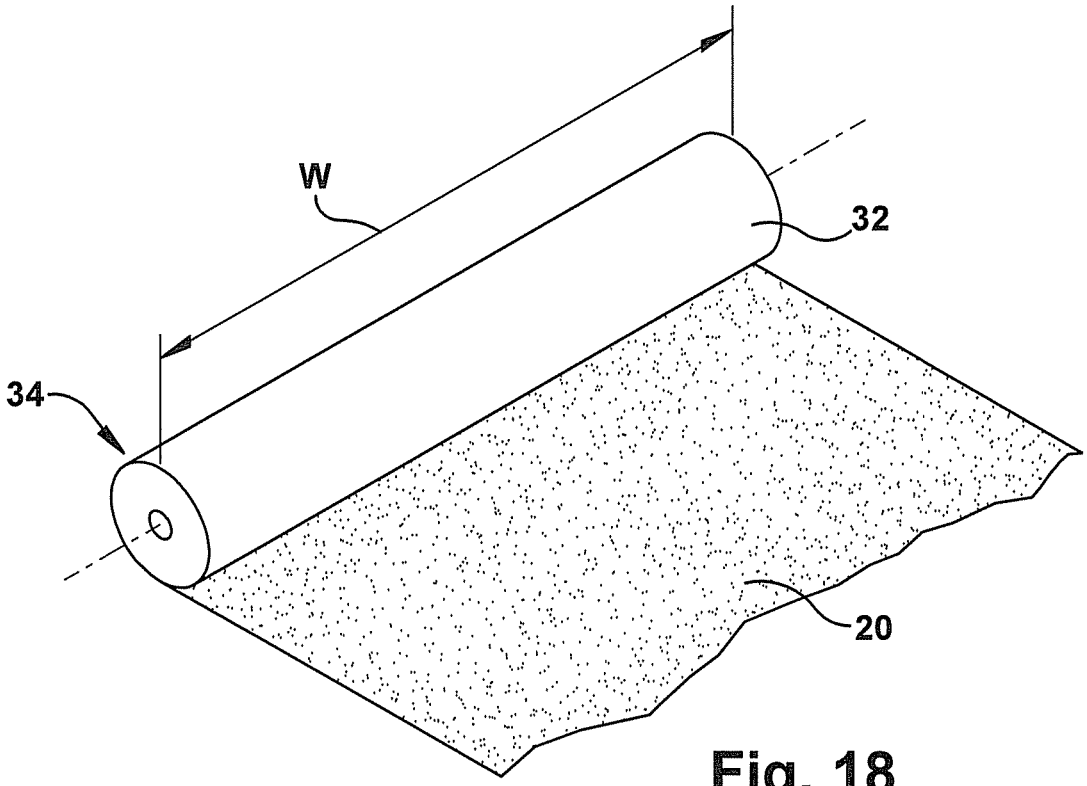
FIG. 18 is perspective view of a roll of the granule-coated roofing membrane.

The granule-coated roofing membrane 20 may then be wound into a roll 34, as shown in FIG. 18. The roll 34 of the granule-coated roofing membrane 20 may have any desired diameter. Alternatively, the granule-coated roofing membrane 20 may be cut to discrete lengths and stacked for subsequent packaging and shipping.

Advantageously, the granule-coated surface 30 of the granule-coated roofing membrane 20 may be manufactured to include colors and/or color blends of granules 28 that match, coordinate with, and/or complement the colors and/or color blends of the granules of the roofing shingles 14 installed on the building structure 10. By matching, coordinating with, and/or complementing the colors and/or color blends of the granules of the roofing shingles 14 with the granule-coated roofing membrane 20, an aesthetically pleasing appearance is achieved.

The granule-coated surface 30 of the granule-coated roofing membrane 20 may prevent any unevenness in the underlying low-slope roof deck 18 from telegraphing through the granule-coated roofing membrane 20 by masking any such unevenness. The granule-coated roofing membrane 20 may have improved weathering performance. In one exemplary embodiment, the addition of ceramic-coated granules to asphaltic roofing materials enhances weathering performance by providing UV protection for the underlying asphalt base. The life expectancy of a typical steep-slope shingle is typically 15 to 20 years or more. Likewise, typical commercial roofing membranes are known to withstand the effects of weather and perform satisfactorily over as many as 10 to 20 years. By combining a robust membrane and ceramic-coated roofing granules, the weathering performance of the granule-coated roofing membrane 20 of the present invention will be improved relative to a typical low-slope and steep-slope roofing products.

EXAMPLES

In the following examples, various membrane configurations were supplied by Seaman Corporation. These membranes were coated on a commercial roofing line operated by Northern Elastomerics, Inc. in Brentwood N.H. Coating consisted of a first asphalt layer 24 on the upper surface followed by a second asphalt layer 26 on the lower surface. Once coated, standard roofing granules 28 supplied by Grantech Inc., were applied to the first asphalt coating 24. A siliconized polyethylene release liner 32 was applied to the second asphalt coating. The final product was cut to length and packaged prior to testing.

Tables 1-4 reflect properties of examples of six granule-coated roofing membranes made in accordance with the present application. All testing is performed at 23° C. +/−2° C. Puncture testing is based on a modified version of ASTM D5602. Modifications include use of an instrumented tensile tester with a ½" radius steel probe at a penetration rate of ½" per minute. Sample size is 4" square, and is held in place with a metal frame having a 2.5" diameter circular, central open area. Testing is done such that the probe penetrates the granule side. Tensile Testing and Tear Testing are based on requirements of ASTM D5147. Granule Embedment (also referred to as granule adhesion, scrubs, or granule loss) is based on ASTM D4977.

Example 1

Figure 12:
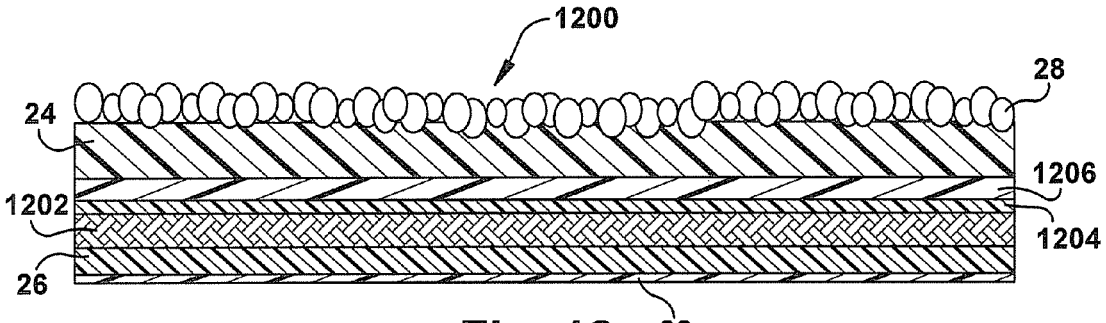
FIG. 12 is an enlarged cross-sectional view of an exemplary embodiment of a granule-coated waterproof roofing membrane.

FIG. 12 schematically illustrates the roofing membrane 1200 of Example 1. The roofing membrane 1200 shown as 1 in Tables 1-4 was produced using an 18 to 20 oz./sq. yd. weft-inserted polyester reinforcement 1202. A PVC based adhesive compound 1204 was coated on the top side of the reinforcement 1202, but not on the bottom side. An additional PVC/Elvaloy blend 1206 was coated on the top, weathering, surface. Total thickness of this construction (1202+1204+1206) was approximately 24 mils. In comparison to Example 6 in Table 1, no adhesive was placed on the bottom side to improve mechanical adhesion of the asphaltic adhesive coating 26.

Example 2

Figure 13:
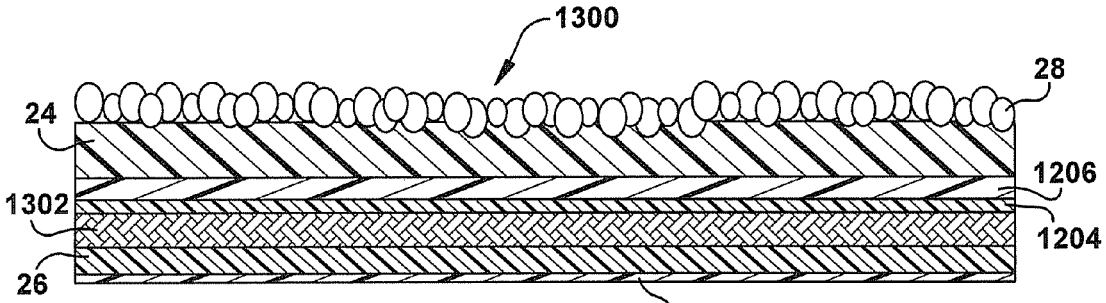
FIG. 13 is an enlarged cross-sectional view of an exemplary embodiment of a granule-coated waterproof roofing membrane.

FIG. 13 schematically illustrates the roofing membrane 1300 of Example 2. The roofing membrane 1300 shown as 2 in Tables 1-4 was produced using an 18 to 20 oz./sq. yd. weft-inserted polyester reinforcement 1302. The yarns used for the reinforcement structure included a texturized polyester yarn. A PVC based adhesive compound 1204 was coated on the top side of the membrane, but not on the bottom side. An additional PVC/Elvaloy blend 1206 was coated on the top, weathering, surface. Total thickness of this construction (1302+1204+1206) was approximately 27 mils. In comparison to 1, a texturized yarn of the polyester reinforcement 1302 was used to provide a "fuzzy" or stranded surface for mechanical adhesion of the asphaltic adhesive coating 26.

Example 3

Figure 14:
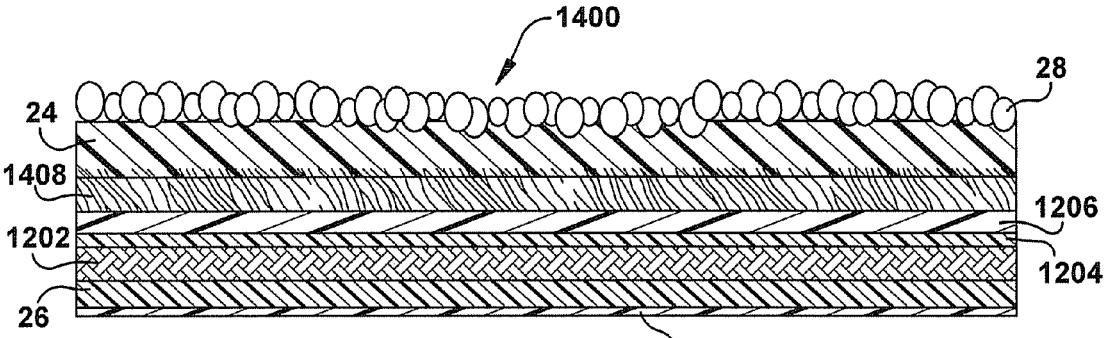
FIG. 14 is an enlarged cross-sectional view of an exemplary embodiment of a granule-coated waterproof roofing membrane.

FIG. 14 schematically illustrates the roofing membrane 1400 of Example 3. The roofing membrane 1400 shown as 3 in Tables 1-4 was produced using an 18 to 20 oz./sq. yd. weft-inserted polyester reinforcement 1202 identical to that used in 1. A PVC based adhesive compound 1204 was coated on the top side of the membrane, but not on the bottom side. An additional PVC/Elvaloy blend 1206 was coated on the top surface. A polyester fleece 1408 was then adhered to the top surface. Total thickness of this construction (1202+1204+1206+1408) was approximately 40 mils. In comparison to 1, the additional fleece was used to provide a "fuzzy" or stranded top surface to promote mechanical adhesion of the asphaltic adhesive coating 24.

Example 4

Figure 15:
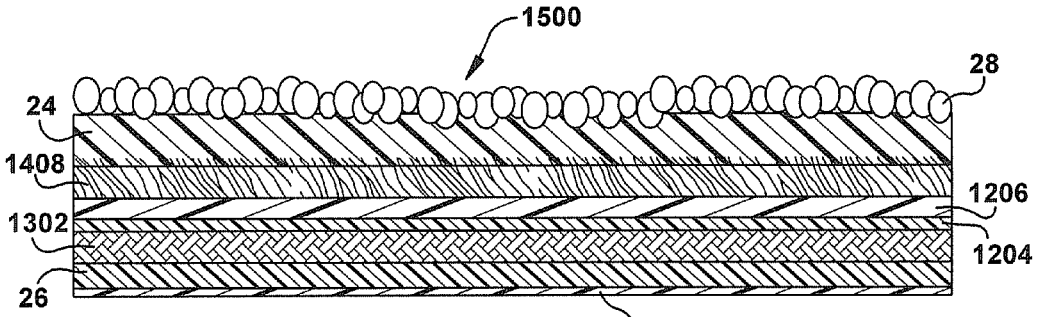
FIG. 15 is an enlarged cross-sectional view of an exemplary embodiment of a granule-coated waterproof roofing membrane.

FIG. 15 schematically illustrates the roofing membrane 1500 of Example 4. The roofing membrane 1500 shown as 4 in Tables 1-4 was produced using an 18 to 20 oz./sq. yd. weft-inserted polyester reinforcement 1302 identical to that used in 2. The yarns used for the reinforcement structure included a texturized polyester yarn. A PVC based adhesive compound 1204 was coated on the top side of the membrane, but not on the bottom side. An additional PVC/Elvaloy blend 1206 was coated on the top surface. A polyester fleece 1408 was then adhered to the top surface. Total thickness of this construction (1302+1204+1206+1408) was approximately 40 mils. In comparison to 2, the additional fleece was used to provide a "fuzzy" top surface to promote mechanical adhesion of the asphaltic adhesive coating 24.

Example 5

Figure 16:
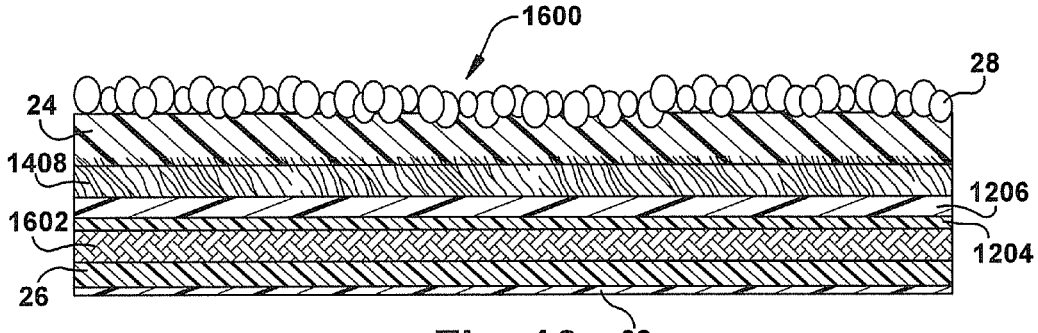
FIG. 16 is an enlarged cross-sectional view of an exemplary embodiment of a granule-coated waterproof roofing membrane.

FIG. 16 schematically illustrates the roofing membrane 1600 of Example 5. The roofing membrane 1600 shown as 5 in Tables 1-4 was produced using a 24 oz./sq. yd. woven or knitted polyester reinforcement 1602. A PVC based adhesive compound 1204 was coated on the top side of the membrane, but not on the bottom side. This modified reinforcement 1602 design provided a tighter weave, preventing bleed-through of the adhesive compound to the back-side of the membrane. An additional PVC/Elvaloy blend 1206 was coated on the top surface. A polyester fleece 1408 was then adhered to the top surface. Total thickness (1602+1204+1206+1408) of this construction was approximately 40 mils. In comparison to 1, the additional fleece was used to provide a "fuzzy" or stranded top surface to promote mechanical adhesion of the asphaltic adhesive coating 24, and the tighter weave provided for a bottom surface virtually free of adhesive compound (caused by bleed-through of the calendering process).

Example 6

Figure 17:
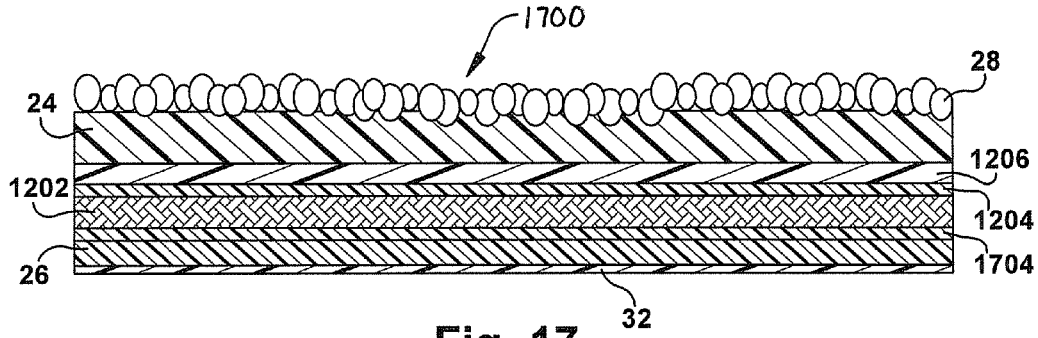
FIG. 17 is an enlarged cross-sectional view of an exemplary embodiment of a granule-coated waterproof roofing membrane.

FIG. 17 schematically illustrates the roofing membrane 1700 of Example 6. The roofing membrane 1700 shown as 6 in Tables 1-4 was produced using an 18 to 20 oz./sq. yd. weft-inserted polyester reinforcement 1202. A PVC based adhesive compound 1204, 1704 was coated on the top and bottom sides of the membrane. An additional PVC/Elvaloy blend 1206 was coated on the top, weathering, surface. Total thickness of this construction (1202+1204+1206+1704) was approximately 27 mils.

Testing of physical properties of these granule-coated roofing membranes is summarized in Table 1. The thicknesses and weights of the granule coated waterproof membranes and the layers of the granule coated waterproof membranes is summarized in Tables 2-4.

TABLE 1

Physical Properties of Example Granule Coated Membranes

| Granule Coated Membrane | Puncture (lbf) | Tensile (lbf/in) CD | Tensile (lbf/in) MD | Tear (lbf) CD | Tear (lbf) MD | Granule Embedment (g) |
|---|---|---|---|---|---|---|
| 1 | 230 | 230 | 280 | 250 | 230 | 1.82 |
| 2 | 190 | 200 | 300 | 140 | 200 | 1.52 |
| 3 | 290 | 300 | 360 | 340 | 330 | 4.23 |
| 4 | 240 | 210 | 370 | 200 | 330 | 3.34 |
| 5 | 250 | 270 | 320 | 310 | 360 | 1.72 |
| 6 | 250 | 260 | 310 | 210 | 200 | 3.12 |

TABLE 2

Granule Coated Waterproof Roofing Membrane Thickness & Weight

| Granule Coated Membrane | Thickness (mils) | Sq Ft Wt (lbs/sq ft) |
|---|---|---|
| 1 | 122.1 | 0.84 |
| 2 | 125.5 | 0.85 |
| 3 | 148.4 | 0.78 |
| 4 | 136.5 | 0.70 |
| 5 | 148.5 | 0.82 |
| 6 | 132.2 | 0.92 |

TABLE 3

Reinforced Waterproof Membrane Thickness & Weight

| Reinforced Waterproof Membrane Construction | Thickness (mils) | Sq Ft Wt (lbs/sq ft) |
|---|---|---|
| 1 | 24.8 | 0.135 |
| 2 | 26.8 | 0.129 |
| 3 | 49.6 | 0.171 |
| 4 | 48.6 | 0.177 |
| 5 | 48.2 | 0.166 |
| 6 | 28.0 | 0.170 |

TABLE 4

Granule Coated Roofing Membrane Composition Thicknesses (Average Values)

| Example | Top Adhesive + Granules (mils) | Reinforced Waterproof membrane (mils) | Bottom adhesive layer (mils) |
|---|---|---|---|
| 1 | 91.8 | 24.8 | 5.5 |
| 2 | 91.7 | 26.8 | 7.0 |
| 3 | 88.8 | 49.6 | 10.0 |
| 4 | 70.2 | 48.6 | 17.7 |
| 5 | 80.5 | 48.2 | 19.8 |
| 6 | 95.9 | 28.0 | 8.3 |

Additionally, granule-coated roofing membrane of the present invention may be formed as a single ply, thereby resulting in reduced material and labor costs relative to typical multi-ply low-slope and steep-slope roofing products.

The principle and mode of operation of the granule-coated waterproof roofing membrane have been described in its preferred embodiments. However, it should be noted that the granule-coated waterproof roofing membranes described herein may be practiced otherwise than as specifically illustrated and described without departing from its scope.

What is claimed is:

1. A granule coated waterproof roofing membrane comprising:

a waterproof membrane layer formed substantially from at least one of: ketone ethylene ester (KEE) resin, polyvinyl chloride (PVC), ethylene propylene diene monomer rubber (EPDM), and thermoplastic polyolefin (TPO);

a reinforcement layer heat bonded to the waterproof membrane layer;

an adhesive layer adhered to a first side of the reinforcement layer;

wherein the reinforcement layer has strands ends that extend into the adhesive layer to enhance the adhesion between the adhesive layer and the waterproof membrane; and a layer of ceramic coated roofing granules adhered to the first adhesive layer, wherein the strand ends that extend into the adhesive layer comprise air textured yarns that have been processed to introduce durable crimps, coils, or loops along a length of the yarn.

2. The roofing membrane according to claim 1, wherein the adhesive layer defines a first adhesive layer, and wherein the roofing membrane further comprises a second adhesive layer bonded to a second side of the membrane layer.

3. The roofing membrane according to claim 2, further comprising a release layer adhered to the second adhesive layer.

4. The roofing membrane according to claim 1, wherein the reinforcement layer is a woven or knitted fibrous material.

5. The roofing membrane according to claim 4, wherein the woven or knitted fibrous material is formed from at least one of polyester fiber, glass fiber, and combinations thereof.

6. The roofing membrane according to claim 1, wherein the reinforcement layer is a non-woven fibrous material.

7. The roofing membrane according to claim 6, wherein the nonwoven or knitted fibrous material is formed from at least one of polyester fiber, glass fiber, and combinations thereof.

8. The roofing membrane of claim 1, wherein the waterproof membrane layer is formed substantially from a blend of ketone ethylene ester and polyvinyl chloride.

9. The roofing membrane according to claim 2, wherein the first and second adhesive layers comprise asphalt.

10. The roofing membrane according to claim 9, wherein the asphalt of the first and second adhesive layers is a polymer modified asphalt.

11. The roofing membrane according to claim 10, wherein the polymer modified asphalt includes one of styrene-butadiene-styrene (SBS), styrene-isoprene-styrene (SIS), styrene-butadiene (SB), and blends thereof.

12. The roofing membrane according to claim 11, wherein the polymer modified asphalt further comprises at least one of a thermoplastic polymer and a thermoplastic polyolefin.

13. The roofing membrane according to claim 12, wherein the polymer modified asphalt further comprises at least one of polyethylene, polypropylene, an ethylene-propylene copolymer, limestone, dolomite, talc, recycled roofing material, tackifying resin, process oil, and wax.

14. The roofing membrane of claim 2, wherein the roofing membrane is self-adhering.

15. The roofing membrane of claim 2, further comprising an adhesion promoting layer between the waterproof membrane and the adhesive layer for enhancing the adhesion between the adhesive layer and the waterproof membrane.

16. The roofing membrane of claim 15, wherein the adhesion promoting layer is a stranded material that has strand ends that extend into the adhesive layer.

17. The roofing membrane of claim 15, wherein the adhesion promoting layer is a stranded material that is bonded to the waterproof membrane and has strand ends that extend into the adhesive layer.

18. The roofing membrane of claim 4, wherein the puncture resistance of the roofing material is from 1751 bf to 2501 bf.

19. A granule coated waterproof roofing membrane comprising:

a waterproof membrane layer formed substantially from at least one of: ketone ethylene ester (KEE) resin, polyvinyl chloride (PVC), ethylene propylene diene monomer rubber (EPDM), and thermoplastic polyolefin (TPO);

a reinforcement layer heat bonded to the waterproof membrane layer;

an adhesive layer adhered to a first side of the reinforcement layer;

wherein the reinforcement layer has strands ends that extend into the adhesive layer to enhance the adhesion between the adhesive layer and the waterproof membrane; and a layer of ceramic coated roofing granules adhered to the first adhesive layer, wherein the strand ends that extend into the adhesive layer comprise air textured yarns that have been processed to introduce durable crimps or coils along a length of the yarn.

* * * * *